US007971454B2

(12) United States Patent
Rapoport

(10) Patent No.: US 7,971,454 B2
(45) Date of Patent: Jul. 5, 2011

(54) BEAKER TYPE DYEING MACHINE

(75) Inventor: Lev Rapoport, Yardley, PA (US)

(73) Assignee: Datacolor Holding AG (CH)

( * ) Notice: Subject to any disclaimer, the term of this patent is extended or adjusted under 35 U.S.C. 154(b) by 352 days.

(21) Appl. No.: 12/181,046

(22) Filed: Jul. 28, 2008

(65) Prior Publication Data

US 2010/0018260 A1 Jan. 28, 2010

(51) Int. Cl.
*D06B 23/14* (2006.01)

(52) U.S. Cl. ..... 68/5 C; 68/5 E; 68/213

(58) Field of Classification Search ..... 68/3 R, 68/5 C, 207, 5 E, 213; 8/158
See application file for complete search history.

(56) References Cited

U.S. PATENT DOCUMENTS

| | | | | | |
|---|---|---|---|---|---|
| 2,094,702 | A | * | 10/1937 | Hexter | 222/144 |
| 2,685,978 | A | * | 8/1954 | Crockett | 222/511 |
| 3,355,112 | A | | 11/1967 | Shaffer et al. | |
| 3,379,038 | A | * | 4/1968 | Blancafort | 68/156 |
| 3,686,726 | A | | 8/1972 | Glaze et al. | |
| 3,715,189 | A | * | 2/1973 | Nighohossian et al. | 422/61 |
| 3,728,877 | A | * | 4/1973 | von Ondarza | 68/13 R |
| 4,059,013 | A | * | 11/1977 | Dietrich | 73/159 |
| 4,321,808 | A | | 3/1982 | Hull | |
| 5,299,606 | A | * | 4/1994 | Schrupp | 141/91 |
| 5,305,925 | A | * | 4/1994 | Vogel | 222/147 |
| 5,391,351 | A | * | 2/1995 | Kaufman | 422/28 |
| 5,596,890 | A | | 1/1997 | Suess | |
| 6,003,346 | A | | 12/1999 | Hsu | |
| 6,626,015 | B1 | * | 9/2003 | Rapoport et al. | 68/147 |
| 6,662,646 | B2 | * | 12/2003 | Hsu | 73/159 |
| 6,957,799 | B2 | * | 10/2005 | Heilmann et al. | 251/82 |
| 2005/0158187 | A1 | | 7/2005 | Fulkerson et al. | |

FOREIGN PATENT DOCUMENTS

| | | | |
|---|---|---|---|
| DE | 24 21 370 | * | 11/1975 |
| JP | 62-299560 | * | 12/1987 |
| JP | 08-271338 | * | 10/1996 |
| JP | 11-190448 | * | 7/1999 |
| JP | 2002-309476 | * | 10/2001 |
| JP | 2004-250825 | * | 9/2004 |
| JP | 200971425 | * | 11/2007 |
| SU | 253739 | * | 11/1970 |

OTHER PUBLICATIONS

European Patent Office 0 384 771 Aug. 1990.*
International Search Report and Written Opinion for PCT/US 09/51838, Nov. 17, 2009, consists of 8 pages.

* cited by examiner

*Primary Examiner* — Frankie L Stinson

(57) ABSTRACT

In one embodiment, the present invention is a beaker type dyeing machine. One embodiment of an apparatus for dyeing a material in a beaker includes a cylinder body having a first end and a second end, the first end being configured for coupling to the lid of the beaker, a check valve incorporated into the first end of the cylinder body, and a plug incorporated into the second end of the cylinder body, the plug being operable to control opening and closing of the check valve.

16 Claims, 4 Drawing Sheets

BEAKER TYPE DYEING MACHINE

FIELD OF THE INVENTION

The invention relates to a beaker type dyeing machine that is especially useful for the controlled dyeing of fabrics and other materials in a laboratory setting.

BACKGROUND OF THE DISCLOSURE

Many processes for dyeing fabrics on an industrial scale require that dyes and other chemicals be added periodically (e.g., according to a predetermined pattern or sequence). Dye application to textiles depends on dosing a liquid water/dye solution with an activator (e.g., soda ash, sodium sulfate, ammonium sulfate, hydrogen peroxide, or other solid or liquid substances). Activation of dyes is typically most effective if performed when the liquid solution reaches a certain temperature, and just prior to the application of the liquid solution to the fabric.

Conventional dyeing methods either manually inject the activator into the liquid solution (e.g., using a syringe) at the appropriate time and temperature or include the activator in the original dye mixture prior to the dyeing process. The former process tends to be tedious and requires the activator to be in a fluid form. The latter process tends to lead to suboptimal dyeing of the fabric.

Thus, there is a need in the art for a beaker type dyeing machine that allows injection of a solid or granular activator.

SUMMARY OF THE INVENTION

In one embodiment, the present invention is a beaker type dyeing machine. One embodiment of an apparatus for dyeing a material in a beaker includes a cylinder body having a first end and a second end, the first end being configured for coupling to the lid of the beaker, a check valve incorporated into the first end of the cylinder body, and a plug incorporated into the second end of cylinder the body, the plug being operable to control opening and closing of the check valve.

BRIEF DESCRIPTION OF THE DRAWINGS

The teachings of the present invention can be readily understood by considering the following detailed description in conjunction with the accompanying drawings, in which.

To facilitate understanding, identical reference numerals have been used, where possible, to designate identical elements that are common to the figures.

DETAILED DESCRIPTION

In one embodiment, the present invention is a beaker type dyeing machine for dye applications that allows injection of a solid or granular activator. Embodiments of the invention incorporate a dispensing cylinder with a manual plunger into the individual beakers of a beaker type dyeing machine. A measured amount of solid or granular activator is stored in each dispensing cylinder and may be dispensed into the beaker upon depression of the plunger by a human operator.

Embodiments of the invention may be incorporated within a beaker type dyeing machine, for example such as that described in U.S. Pat. No. 6,626,015, which is herein incorporated by reference in its entirety.

Figure 1:
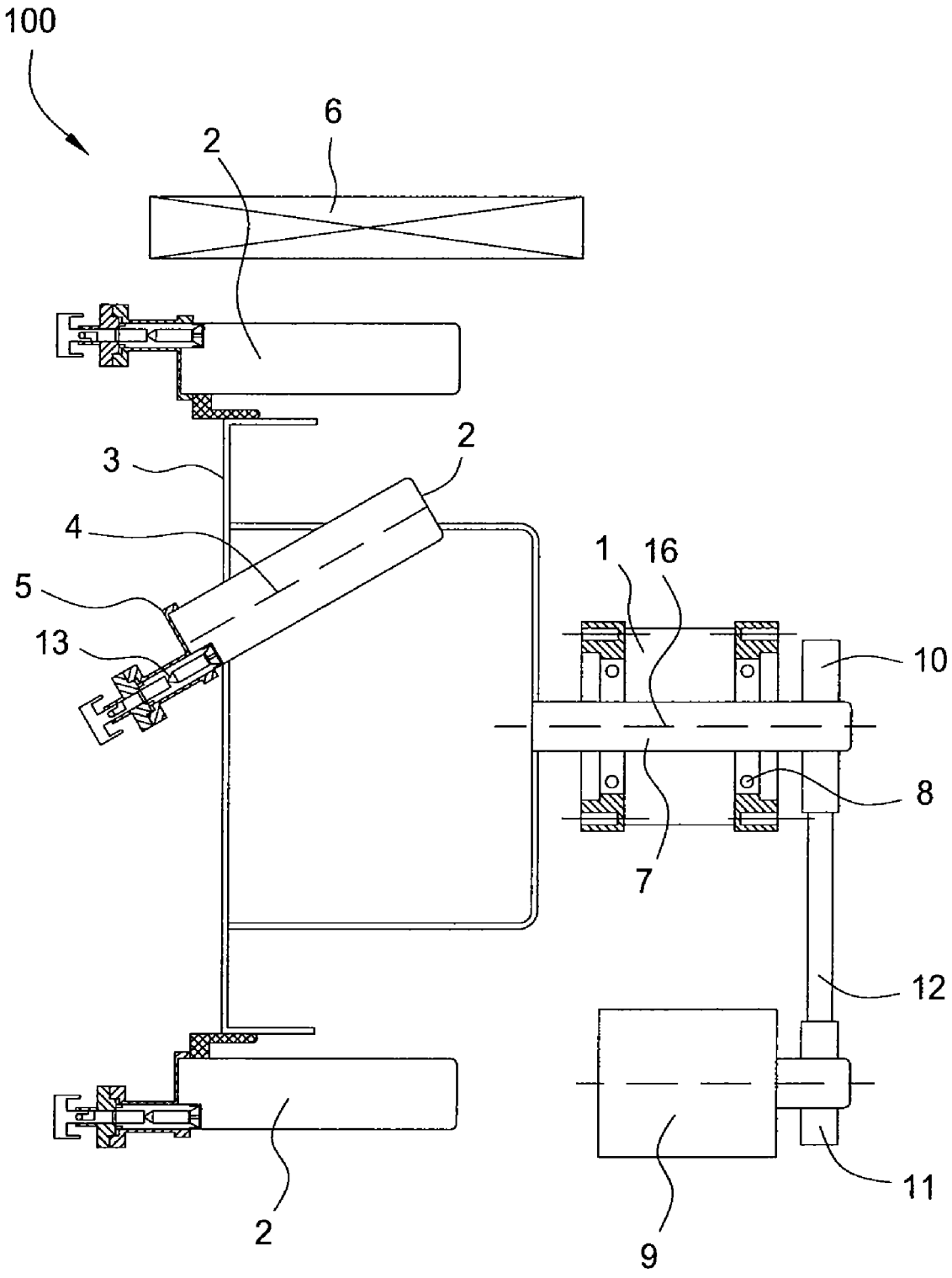
FIG. 1 is a side view illustrating one embodiment of a beaker type dyeing machine, according to the present invention.

FIG. 1 is a side view illustrating one embodiment of a beaker type dyeing machine 100, according to the present invention. As illustrated, the machine 100 comprises a support 1, a substantially circular disk 3 coupled to the support 1, and a plurality of beakers 2 arranged along the periphery of the circular disk 3. Although the disk 3 is described as being circular in shape, the disk 3 may comprise any shape that is rotatable about an axis of rotation and that can support a plurality of beakers 2 along its periphery. A heater 6 is positioned at a point on the periphery of the circular disk 3 such that the beakers 2 and their contents are heated as the circular disk 3 is rotated and the beakers 2 pass the heater 6. In one embodiment, the heater 6 is a planar infrared emitter.

The support 1 comprises a shaft 7 to which the circular disk 3 is directly coupled. Thus, the axis of rotation 16 of the circular disk 3 is disposed through the center of the shaft 7. The shaft 7 is rotated on bearings 8 and is driven by a motor 9 that continuously rotates the shaft 7 (e.g., in a clockwise or counter-clockwise direction), thereby continuously rotating the circular disk 3 (and the beakers 2) about the axis of rotation 16. In one embodiment, the motor 9 rotates the shaft 7 such that the beakers 2 coupled to the circular disk 3 are rotated at a uniform or non-uniform speed.

In one embodiment, the motor 9 is a timing belt. In this embodiment, a first timing pulley 10 is coupled to the shaft 7, and a second timing pulley 11 is coupled to the motor 9. A timing belt 12 couples the first timing pulley 10 to the second timing pulley 11.

As discussed above, the plurality of beakers 2 is arranged around the periphery of the circular disk 3. In one embodiment, each beaker 2 is positioned such that its longitudinal axis 4 extends in a diagonal or slanted orientation in two planes relative to the axis of rotation 16 of the circular disk 3.

The beakers 2 are designed to contain material (e.g., fabric) to be dyed and a liquid solution of dye and water. Each beaker 2 has a lid 5 to which a dispensing cylinder 13 (illustrated in further detail in FIGS. 2-4) is coupled, such that the dispensing cylinder 13 extends into the interior volume of the beaker 2. The dispensing cylinder 13 is filled with a solid or granular activator (not illustrated) that is manually dispensed into the beaker 2 at the appropriate time and temperature.

Figure 2:
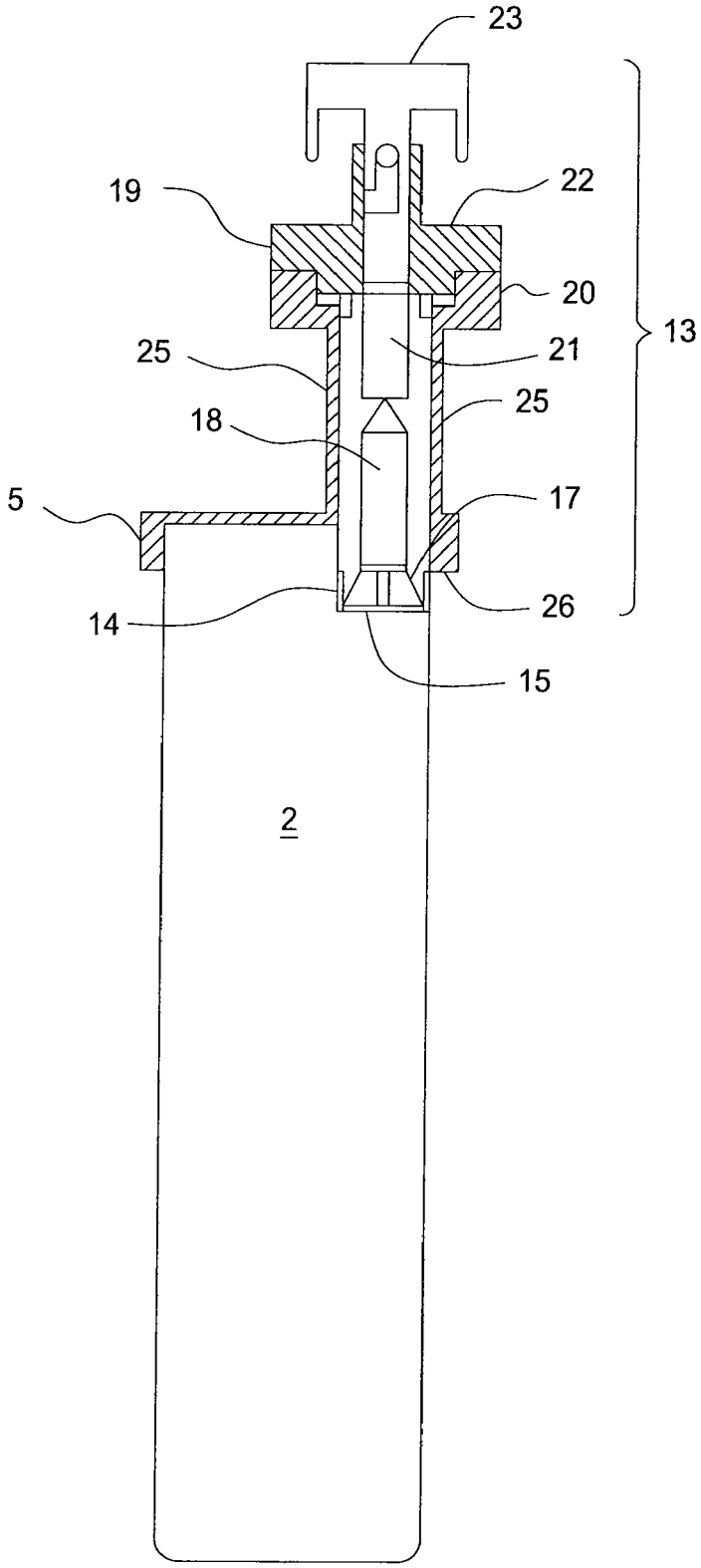
FIGS. 2-3 are side views illustrating one embodiment of a dispensing cylinder coupled to a beaker.
Figure 3:
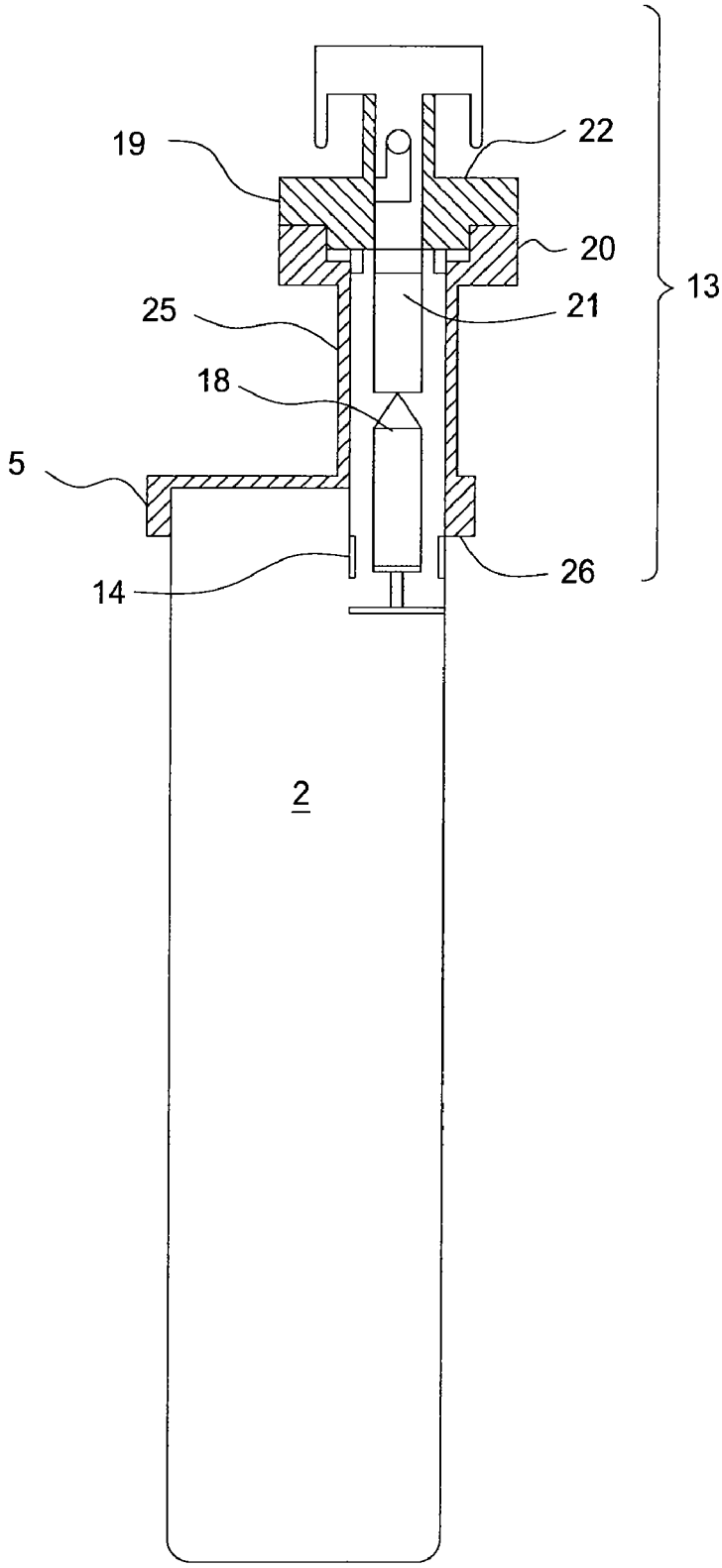

FIGS. 2-3 are side views illustrating one embodiment of a dispensing cylinder 13 coupled to a beaker 2. Specifically, FIG. 2 illustrates the dispensing cylinder 13 with a check valve 14 in the "closed" position, while FIG. 3 illustrates the dispensing cylinder 13 with the check valve 14 in the "open" position.

The dispensing cylinder 13 comprises a cylinder body 25 and a removable plug 19. A first end of the cylinder body 25 is disposed through the lid 5 of the beaker 2 and is sealed from the interior volume of the beaker 2 by the check valve 14. An opposite second end of the cylinder body 25 is sealed by the removable plug 19.

The check valve 14 comprises a piston 15 that is coupled to a first rod 18. A biasing element 17 such as a spring biases the first rod 18 in a direction away from the beaker 2 (i.e., away from the first end of the cylinder body 25). A first seal member 26 such as an O-ring seals the check valve 14 from the interior volume of the beaker 2.

The removable plug 19 comprises a second rod 21 coupled to a knob 23. The second rod 21 is coupled to the knob 23 by a second seal member 22 such as an O-ring. A third seal member 20 such as an O-ring seals the removable plug 19 to the cylinder body 25. When the removable plug 19 is inserted into the cylinder body 25, the first rod 18 is biased by the biasing element 17 against the second rod 21, as illustrated in FIG. 2. This closes the check valve 14, so that any activator stored within the dispensing cylinder 13 is prevented from escaping into the beaker 2.

To open the check valve 14 and dispense the activator, the knob 23 of the removable plug 19 is depressed (e.g., by a human operator). This forces the second rod 21 against the first rod 18, pushing back on the biasing element 17 and opening the check valve 14 as illustrated in FIG. 3. In one embodiment, the dispensing cylinder 13 additionally comprises a locking element for reversibly locking the check valve in the open position.

The dispensing cylinder 13 thus allows activator and/or other additives in solid or granular form to be added to the contents of a beaker 2 while the circular disk 3 of the beaker type dyeing machine 100 rotates. Thus, the activator may be added to the liquid dye solution without interruption the movement of the beakers 2. Subsequent agitation of the beakers 2 causes the activator to dissolve in the liquid dye solution, rendering the liquid dye solution suitable for application to the materials to be dyed.

Figure 4:
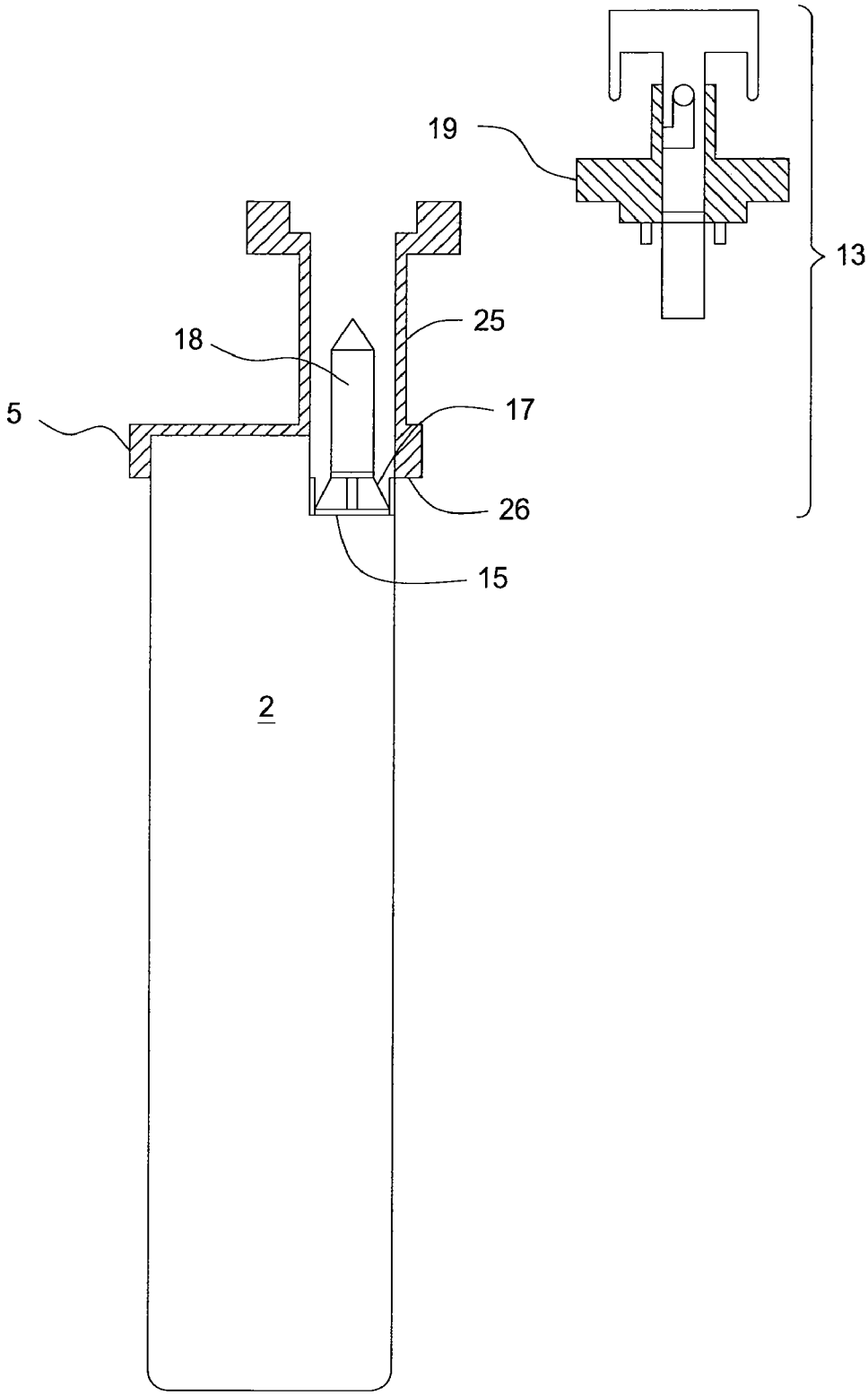
FIG. 4 is a side view illustrating the dispensing cylinder with the removable plug removed.

FIG. 4 is a side view illustrating the dispensing cylinder 13 with the removable plug 19 removed. Removing the removable plug 19 allows the dispensing cylinder 13 to be filled with the activator or other additives.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An apparatus for dyeing a material in a beaker, the apparatus comprising:
- a cylinder body having a first end and a second end, the first end being configured for coupling to a lid of the beaker;
- a check valve incorporated into the first end of the cylinder body, wherein the check valve comprises:
  - a piston;
  - a first rod coupled to the piston; and
  - a biasing element biasing the first rod in a direction away from the first end of the cylinder body; and
- a plug incorporated into the second end of the cylinder body, the plug being operable to control opening and closing of the check valve, wherein the plug comprises:
  - a knob; and
  - a second rod coupled to the knob,
  - wherein the plug is positioned in the second end of the cylinder body such that the first rod is biased against the second rod by the biasing element.

2. The apparatus of claim 1, wherein a depression of the knob pushes the second rod against the first rod such that the check valve is opened.

3. The apparatus of claim 1, further comprising:
- a seal member positioned to seal the plug to the cylinder body.

4. The apparatus of claim 1, wherein the plug is removable from the second end of the cylinder body.

5. The apparatus of claim 1, further comprising:
- a seal member positioned to seal the check valve from an interior volume of the beaker.

6. The apparatus of claim 1, further comprising:
- a solid or granular activator stored within the cylinder body.

7. The apparatus of claim 1, further comprising:
- a beaker coupled to the first end of the cylinder body, such that the first end of the cylinder body extends into an interior volume of the beaker.

8. An apparatus for dyeing a material, the apparatus comprising:
- a disk rotatable about an axis of rotation;
- a plurality of beakers arranged along a periphery of the disk, each of the plurality of beakers being configured to contain the material and a dye solution for dyeing the material; and
- a plurality of dispensing cylinders, each of the plurality of dispensing cylinders being coupled to a respective one of the plurality of beakers, each of the plurality of dispensing cylinders comprising:
  - a cylinder body having a first end and a second end, the first end being configured for coupling to a lid of the respective one of the plurality of beakers;
  - a check valve incorporated into the first end of the cylinder body, wherein the check valve comprises:
    - a piston;
    - a first rod coupled to the piston; and
    - a biasing element biasing the first rod in a direction away from the first end of the cylinder body; and
  - a plug incorporated into the second end of the cylinder body, the plug being operable to control opening and closing of the check valve, wherein the plug comprises:
    - a knob; and
    - a second rod coupled to the knob,
    - wherein the plug is positioned in the second end of the cylinder body such that the first rod is biased against the second rod by the biasing element.

9. The apparatus of claim 8, wherein a depression of the knob pushes the second rod against the first rod such that the check valve is opened.

10. The apparatus of claim 8, further comprising:
- a seal member positioned to seal the plug to the cylinder body.

11. The apparatus of claim 8, wherein the plug is removable from the second end of the cylinder body.

12. The apparatus of claim 8, further comprising:
- a seal member positioned to seal the check valve from an interior volume of the respective one of the plurality of beakers.

13. The apparatus of claim 8, further comprising:
- a solid or granular activator stored within the cylinder body.

14. The apparatus of claim 8, further comprising:
- a shaft coupled to the disk, the axis of rotation being disposed through a center of the shaft; and
- a motor for rotating the shaft about the axis of rotation.

15. The apparatus of claim 14, wherein the motor is a timing belt.

16. The apparatus of claim 8, wherein each of the plurality of beakers is positioned such that a longitudinal axis of each of the plurality of beakers extends in a slanted orientation in two planes relative to the axis of rotation.

* * * * *